US008080748B2

(12) United States Patent
Kapples et al.

(10) Patent No.: US 8,080,748 B2
(45) Date of Patent: Dec. 20, 2011

(54) CIRCUIT BREAKER WITH ADJUSTABLE SPRING ASSEMBLY BIASING

(75) Inventors: Lawrence Joseph Kapples, Pittsburgh, PA (US); David Curtis Turner, Imperial, PA (US); Mark Allen McAfee, Aliquippa, PA (US)

(73) Assignee: Eaton Corporation, Cleveland, OH (US)

( * ) Notice: Subject to any disclaimer, the term of this patent is extended or adjusted under 35 U.S.C. 154(b) by 271 days.

(21) Appl. No.: 12/420,597

(22) Filed: Apr. 8, 2009

(65) Prior Publication Data

US 2010/0258416 A1 Oct. 14, 2010

(51) Int. Cl.
*H01H 1/22* (2006.01)

(52) U.S. Cl. ..... 200/244

(58) Field of Classification Search ..... 200/244; 335/15

See application file for complete search history.

(56) References Cited

U.S. PATENT DOCUMENTS

| | | | | |
|---|---|---|---|---|
| 5,694,098 | A | 12/1997 | Mody et al. | |
| 6,005,206 | A | 12/1999 | Rakus et al. | |
| 7,034,642 | B1 * | 4/2006 | Rakus et al. | 335/16 |
| 7,351,927 | B1 * | 4/2008 | Rakus et al. | 200/244 |
| 7,474,179 | B2 * | 1/2009 | Weister et al. | 335/15 |
| 7,518,074 | B2 * | 4/2009 | Weister et al. | 200/244 |
| 7,569,784 | B2 * | 8/2009 | Rakus et al. | 200/244 |
| 7,646,269 | B2 * | 1/2010 | Weister et al. | 335/16 |
| 7,683,276 | B2 * | 3/2010 | Weister et al. | 200/244 |
| 2008/0087531 | A1 * | 4/2008 | Rakus et al. | 200/244 |
| 2010/0258415 | A1 * | 10/2010 | Kapples et al. | 200/244 |

* cited by examiner

*Primary Examiner* — Vanessa Girardi
(74) *Attorney, Agent, or Firm* — Martin J. Moran

(57) ABSTRACT

An adjustable carrier assembly is provided for an electrical switching apparatus such as, for example, a circuit breaker. The adjustable carrier assembly includes a carrier body having a first carrier member and a second carrier member pivotably coupled to the first carrier member. An adjustment mechanism is coupled to the carrier body, and a plurality of springs is disposed between the adjustment mechanism and the second carrier member. The springs apply a bias force on the second carrier member, and the adjustment mechanism is adjustable with respect to the carrier body in order to adjust the bias force.

14 Claims, 6 Drawing Sheets

CIRCUIT BREAKER WITH ADJUSTABLE SPRING ASSEMBLY BIASING

CROSS-REFERENCE TO RELATED APPLICATION

This application is related to commonly assigned, concurrently filed: U.S. patent application Ser. No. 12/420593, filed Apr. 8, 2009, entitled "ELECTRICAL SWITCHING APPARATUS, AND CARRIER ASSEMBLY AND SPRING GUIDE THEREFOR".

BACKGROUND

1. Field

The disclosed concept relates generally to electrical switching apparatus and, more particularly, to electrical switching apparatus, such as circuit breakers. The disclosed concept also relates to carrier assemblies for electrical switching apparatus.

2. Background Information

Electrical switching apparatus, such as circuit breakers, provide protection for electrical systems from electrical fault conditions such as, for example, current overloads, short circuits, abnormal voltage and other fault conditions. Typically, circuit breakers include an operating mechanism which opens electrical contact assemblies to interrupt the flow of current through the conductors of an electrical system in response to such fault conditions.

As shown in FIG. 1, the electrical contact assemblies of some circuit breakers include a movable contact assembly 1 having a plurality of movable contacts 3, which are movable into and out of electrical contact with corresponding stationary contacts (not shown). Specifically, the movable contacts 3 are disposed on movable contact arms or fingers 5, which are pivotably coupled to a carrier assembly 7 (see also FIGS. 2A and 2B). The carrier assembly 7 includes a plurality of contact springs 9, shown in FIGS. 2A and 2B, which are structured to bias the fingers 5 (FIG. 1) and corresponding movable contacts 3 (FIG. 1) disposed thereon against the stationary contacts (not shown) in order to provide and maintain contact pressure when the circuit breaker is closed, and to accommodate wear. The carrier assembly 7 also includes a plurality of blow off springs 11 (also sometimes referred to as cam springs) (best shown in the exploded view of FIG. 2B), which are structured to reduce circuit breaker fault clearing times. That is, the carrier assembly 7 is designed to be current-limiting such that the movable contacts 3 (FIG. 1) of the movable contact assembly 1 "blow off" (e.g., separate from) the corresponding stationary contacts (not shown) under relatively high current fault conditions.

Among other disadvantages, such carrier assembly designs include numerous parts and are relatively difficult to assemble. For example and without limitation, as shown in the example of FIGS. 2A and 2B, the carrier assembly 7 includes as many as 20 or more contact springs 9, which are difficult to assemble and difficult to properly align with the corresponding fingers 5 (FIG. 1) of the assembly carrier assembly 7. Improper alignment results in inconsistent spring force, and a lower than desired withstand rating for the circuit breaker. Such carrier assembly designs are also sensitive to dimensional variations among the various components of the carrier assembly 7 which, on one hand, can result in undesirably low blow off forces (e.g., nuisance blow where unintended electrical disconnection occurs) and, on the other hand, can contribute to undesirably high blow off forces potentially leading to higher than desired current being let through the circuit breaker and causing damage to the circuit breaker.

Furthermore, to ensure that the circuit breaker will function properly in service, certain carrier assemblies (e.g., 7) are tested to verify that the required blow off force is within predetermined upper and lower limits. Therefore, such carrier assemblies are rejected if they do not fall within the prescribed upper and lower limits. It is desirable to minimize the number of rejections in order to maximize production yield, particularly in view of the relatively high cost of the carrier assembly (e.g., 7).

There is, therefore, room for improvement in electrical switching apparatus, such as circuit breakers, and in carrier assemblies therefor.

SUMMARY

These needs and others are met by embodiments of the disclosed concept, which are directed to an adjustable carrier assembly for the movable contact assembly of an electrical switching apparatus, such as a circuit breaker. Among other benefits, the adjustable nature of the carrier assembly enables it to be relatively quickly and easily assembled and adjusted to be within requisite or desired engineering specification limits (e.g., for blow off force).

As one aspect of the disclosed concept, an adjustable carrier assembly is provided for an electrical switching apparatus. The adjustable carrier assembly comprises: a carrier body comprising a first carrier member and a second carrier member pivotably coupled to the first carrier member; an adjustment mechanism coupled to the carrier body; and a plurality of springs disposed between the adjustment mechanism and the second carrier member, the springs being structured to apply a bias force on the second carrier member. The adjustment mechanism is adjustable with respect to the carrier body in order to adjust the bias force.

The adjustment mechanism may comprise an elongated member and a number of fasteners, wherein the fasteners fasten the elongated member to the first carrier member of the carrier body. The fasteners may be structured to be tightened to move the elongated member toward the first carrier member, thereby increasing the bias force, and to be loosened to move the elongated member away from the first carrier member, thereby decreasing the bias force.

As another aspect of the disclosed concept, an electrical switching apparatus comprises: a number of stationary contacts; and at least one carrier assembly comprising: a carrier body comprising a first carrier member and a second carrier member pivotably coupled to the first carrier member, a plurality of movable contact arms coupled to the second carrier member, each of the movable contact arms including a movable contact being movable into and out of electrical contact with a corresponding one of the number of stationary contacts, an adjustment mechanism coupled to the carrier body, and a plurality of springs disposed between the adjustment mechanism and the second carrier member, the springs applying a bias force on the second carrier member. The adjustment mechanism is adjustable with respect to the carrier body in order to adjust the bias force.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
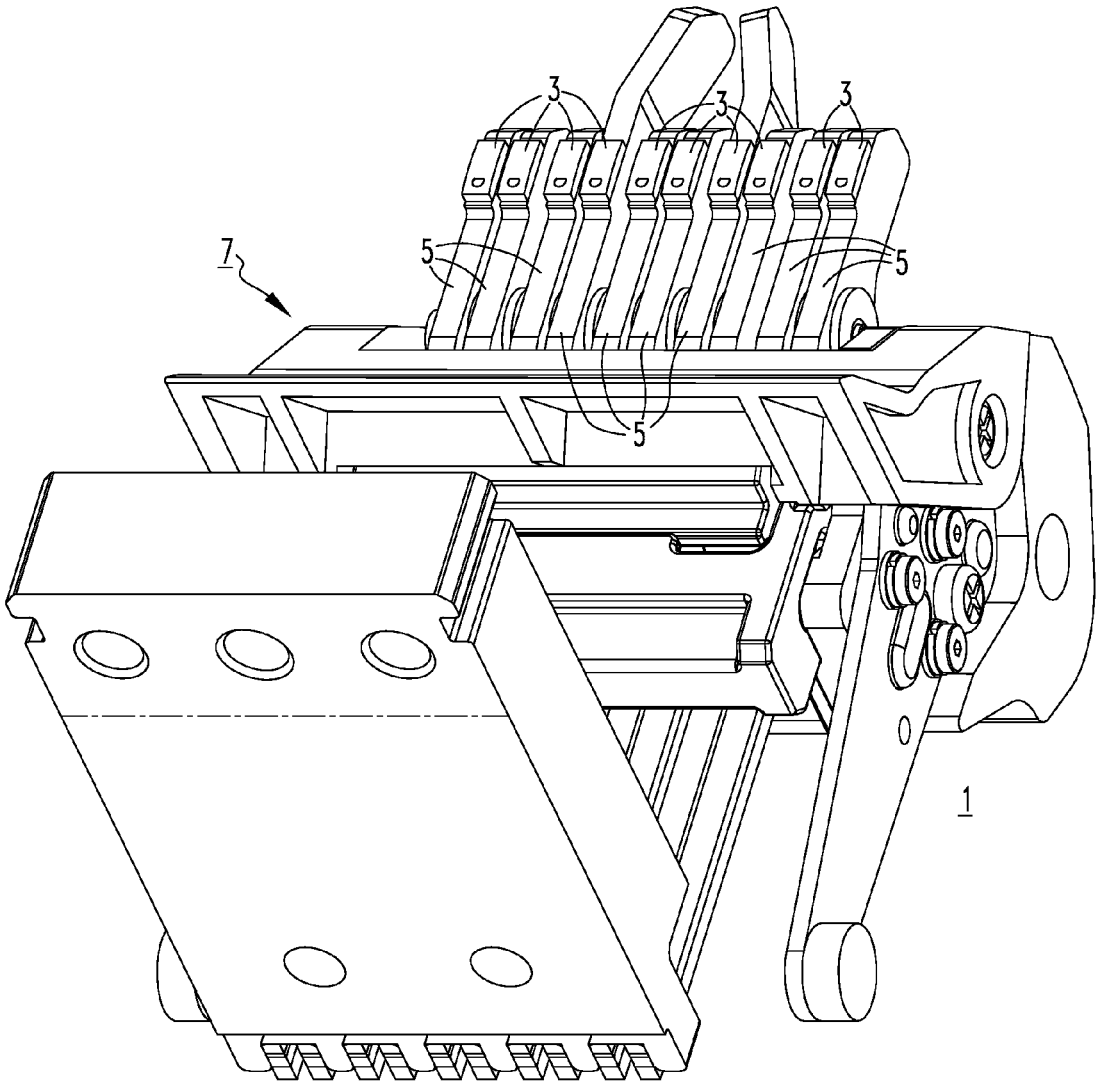
FIG.1 PRIOR ART
FIG. 1 is an isometric view of a movable contact assembly and carrier assembly therefor.

Directional phrases used herein, such as, for example, left, right, beneath, under and derivatives thereof, relate to the orientation of the elements shown in the drawings and are not limiting upon the claims unless expressly recited therein.

As employed herein, the term "blow off force" refers to the electromagnetic force that tends to open electrical contact between separable electrical contacts (e.g., stationary contacts; movable contacts). Under certain electrical fault conditions (e.g., without limitation, current overloads; short circuits; other fault conditions), an opposing bias force is surpassed by the blow off force, resulting in the movable contact(s) blowing off of the corresponding stationary contact(s) to break the flow of electric current therethrough.

The term "blow open force" means the same as the term "blow off force". For example, in switching apparatus incorporating current limiting contact structures, the separable contacts are commonly arranged to provide a particular length of conductor for providing reversely directed parallel current paths in parallel conductor members. As the magnitude of the current increases, the current generates electromagnetic forces which dynamically repel the conductor members. If one conductor member is fixed, the repelling magnetic force is directed upon the movable conductor member as a blow open force which drives the movable conductor member away from the fixed conductor member to separate the contacts. See, for example, U.S. Pat. No. 5,694,098.

As employed herein, the term "fastener" refers to any suitable connecting or tightening mechanism expressly including, but not limited to, screws (e.g., without limitation, set screws), bolts and the combinations of bolts and nuts (e.g., without limitation, lock nuts) and bolts, washers and nuts.

As employed herein, the statement that two or more parts are "coupled" together shall mean that the parts are joined together either directly or joined through one or more intermediate parts.

As employed herein, the term "number" shall mean one or an integer greater than one (i.e., a plurality).

Figure 3:
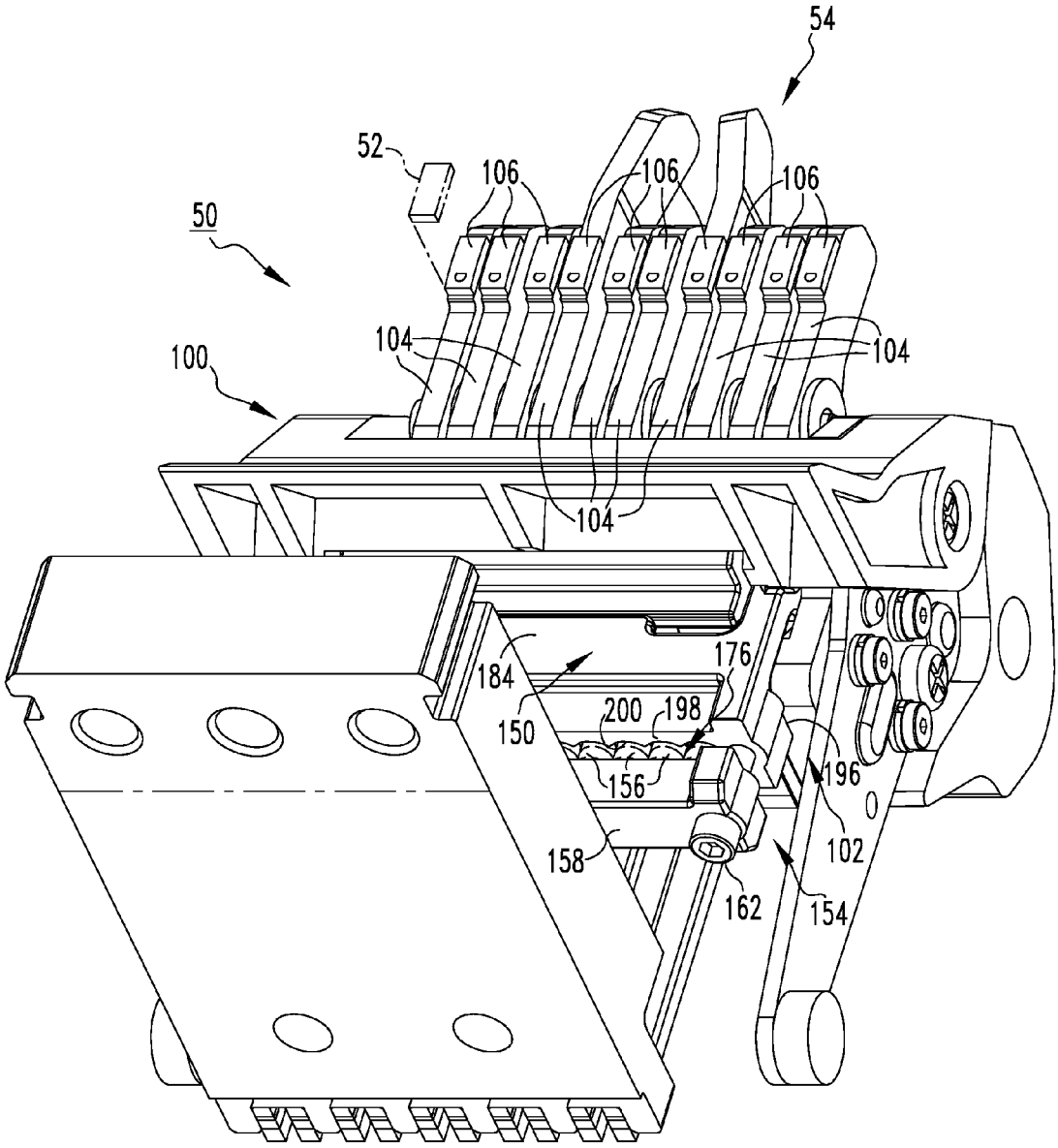
FIG. 3 is an isometric view of a carrier assembly, in accordance with embodiments of the disclosed concept.
Figure 4A:
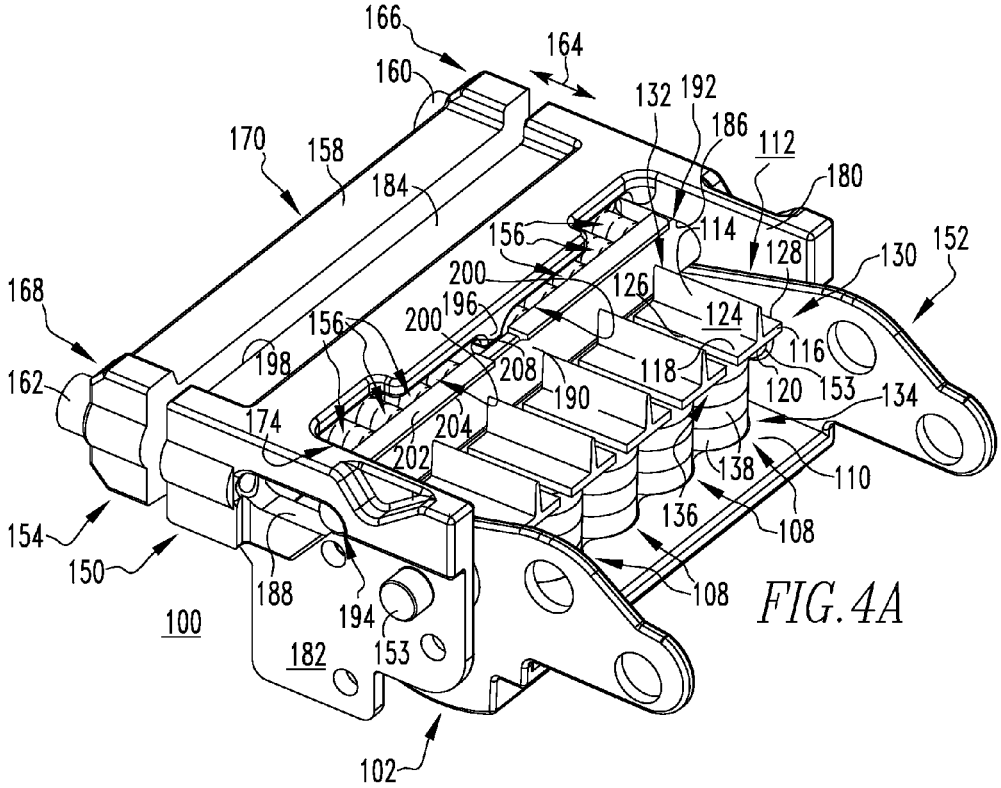
FIG. 4A is an isometric view of the carrier assembly of FIG. 3.
Figure 4B:
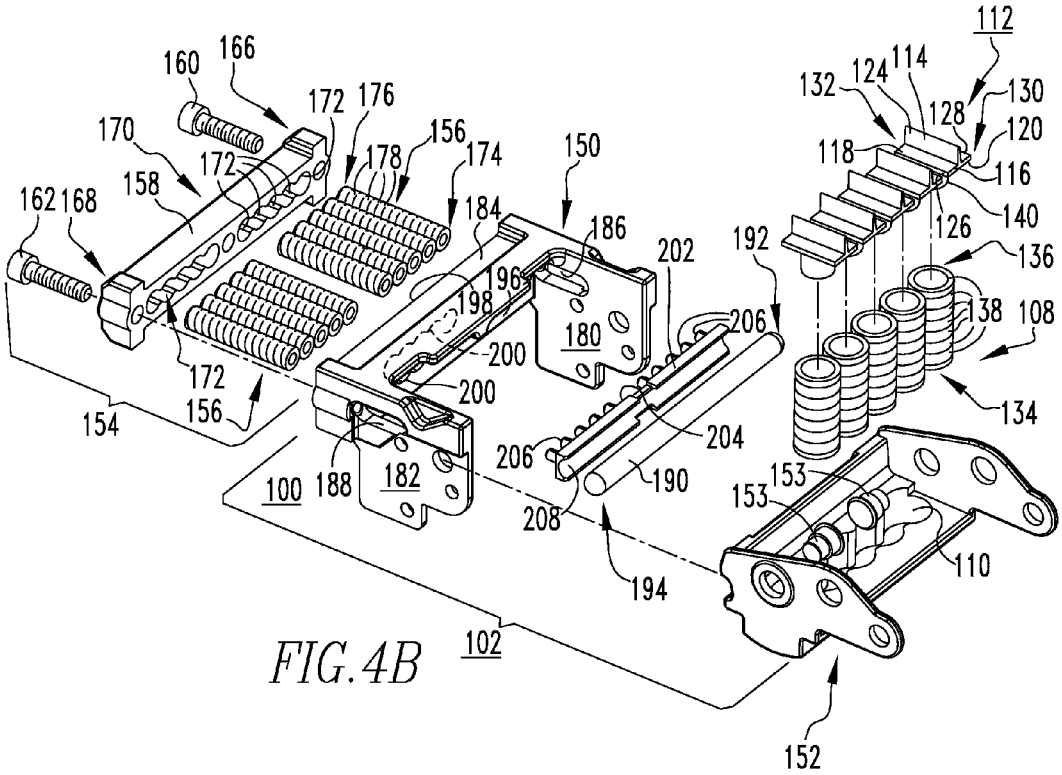
FIG. 4B is an exploded isometric view of the carrier assembly of FIG. 4A.

FIGS. 3, 4A and 4B show a carrier assembly 100 for an electrical switching apparatus such as, for example, a circuit breaker (indicated generally by reference 50 in FIG. 3), which includes a number of poles (one pole is generally indicated by reference 54 in FIG. 3) each having a number of stationary contacts 52 (one stationary contact 52 is shown in simplified form in phantom line drawing in FIG. 3). For economy of disclosure and ease of illustration, one carrier assembly 100 is shown and described herein, although it will be appreciated that the circuit breaker 50 (FIG. 3) could employ any known or suitable alternative number of carrier assemblies (e.g., 100). For example and without limitation, each pole (e.g., 54 (FIG. 3)) of the circuit breaker 50 (e.g., 50 (FIG. 3)) could include a corresponding carrier assembly (e.g., 100) such that, for example and without limitation, a three-pole circuit breaker would include three carrier assemblies 100, one for each pole.

Each carrier assembly 100 includes a carrier body 102, a plurality of movable contact arms 104 pivotably coupled to the carrier body 102, and a plurality of movable contacts 106 disposed on the movable contact arms 104, as shown in FIG. 3. Each of the movable contacts 106 is movable into (not shown) and out of (FIG. 3) electrical contact with a corresponding one of the stationary contacts 52 (shown in simplified form in phantom line drawing in FIG. 3), in a generally well known manner. For ease of illustration, the movable contact arms 104 are not shown in FIGS. 4A and 4B. Rather, the movable contact arms 104 (FIGS. 3 and 6) have been removed from FIGS. 4A and 4B to show underlying structures, such as the plurality of contact springs 108, which are disposed beneath the movable contact arms 104 (FIGS. 3 and 6).

Figure 5A:
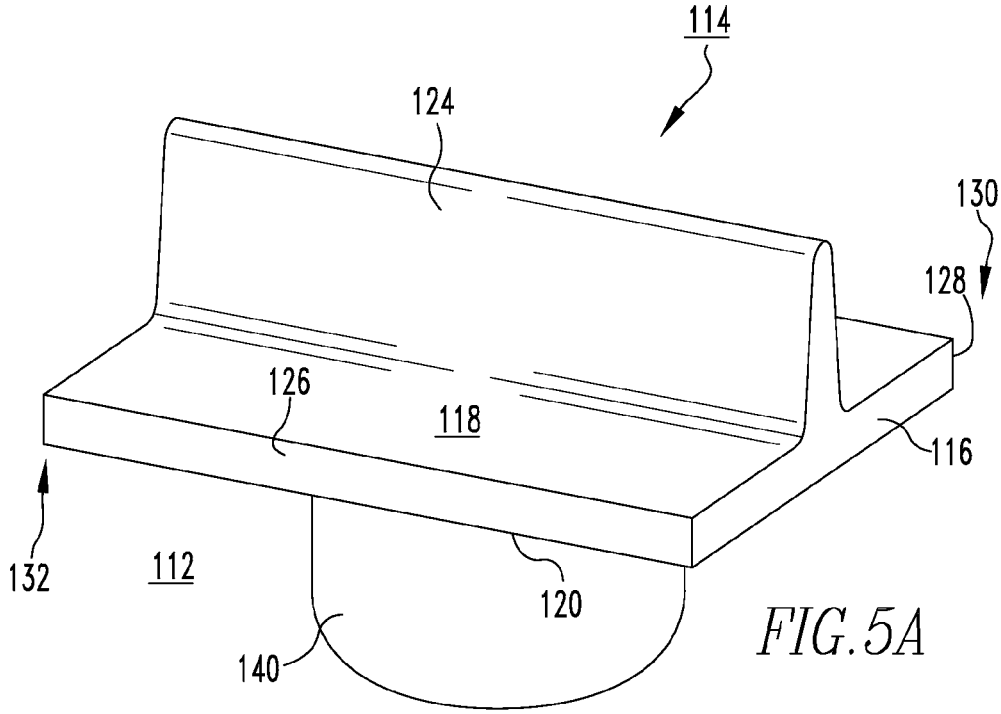
FIGS. 5A and 5B are isometric and end elevation views, respectively, of one of the spring guides for the carrier assembly of FIG. 4B.
Figure 5B:
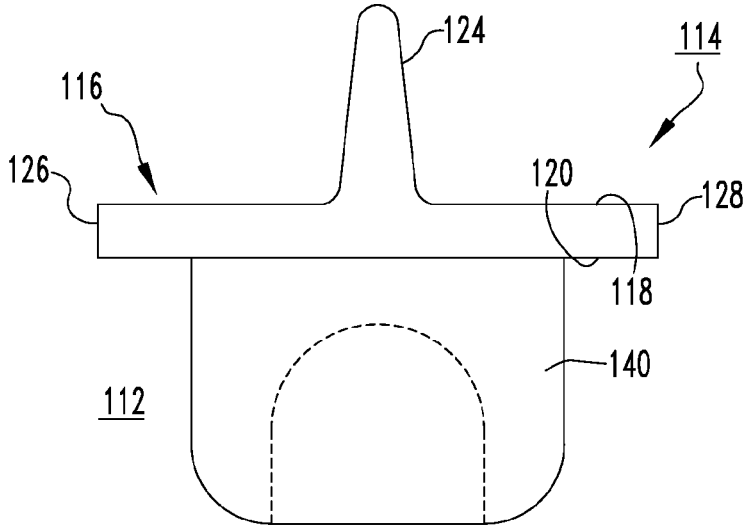
Figure 6:
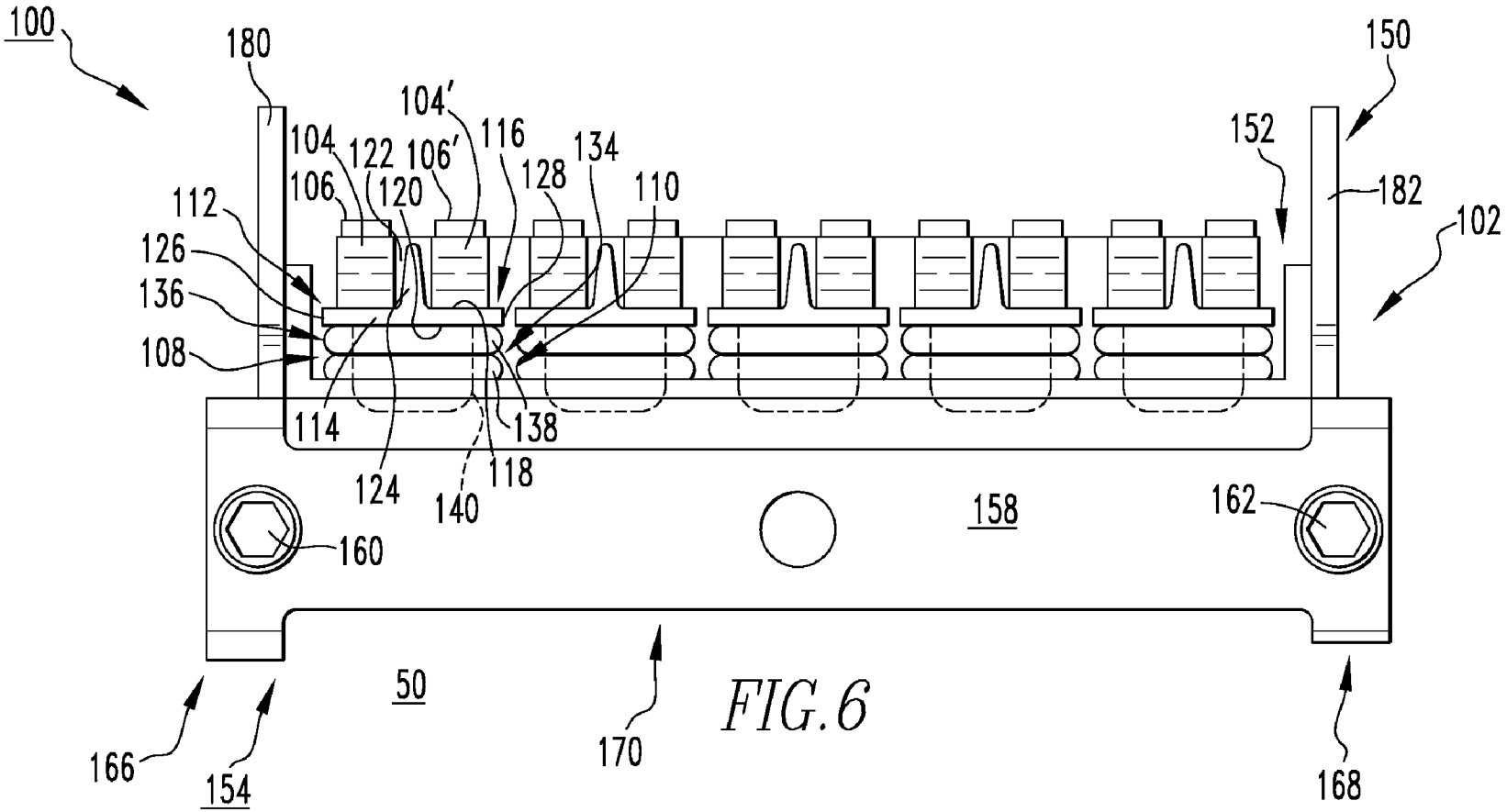
FIG. 6 is an end elevation view of the carrier assembly of FIG. 4A.

Each of the contact springs 108 is disposed between a portion 110 of the carrier body 102 and a corresponding number of the movable contact arms 104 (FIGS. 3 and 6). For example, as best shown in the end elevation view of FIG. 6, contact spring 108 is disposed between portion 110 of carrier body 102 and the adjacent pair of movable contact arms 104,104'. In the example of FIGS. 4A, 4B and 6, the carrier assembly includes five contact springs 108, each structured to bias a corresponding adjacent pair (see, for example, adjacent pair of movable contact arms 104,104' of FIG. 6) of the ten total movable contact arms 104 that are present (see FIGS. 3 and 6). It will, however, be appreciated that the carrier assembly 100 could include any known or suitable alternative number and/or configuration of contact springs 108, movable contact arms 104,104' (FIG. 6) and/or spring guides 112 (discussed hereinbelow with respect to FIGS. 4A-6), without departing from the scope of the disclosed concept. It will also be appreciated that, for ease of illustration, the features (e.g., first end 134; second end 136; coils 138) of only one contact spring 108 are labeled (see, for example, FIGS. 4A, 4B and 6). The other four contact springs 108 are substantially identical.

Continuing to refer to FIGS. 4A and 4B, as well as FIGS. 5A and 5B, it will be appreciated that each of the spring guides 112 includes a guide member 114 structured to be disposed between a corresponding one of the contact springs 108 and the corresponding adjacent pair of movable contact arms 104,104', as shown in FIG. 6. In this manner, the spring guide 112 maintains alignment between the contact spring 108 and the corresponding pair of adjacent movable contact arms 104,104' (FIG. 6). More specifically, the guide member 114 includes a planar portion 116 having first and second opposing sides 118,120. The first side 118 spans at least two of the movable contact arms 104 (see, for example, first side 118 of the planar portion 116 of guide member 114 of FIG. 6 spanning the pair of adjacent movable contact arms 104,104'). The second side 120 of the planar portion 116 engages the corresponding contact spring 108, as shown in FIG. 6.

As shown in FIG. 6, a protrusion 124, which extends outwardly from the first side 118 of the planar portion 116 of the guide member 114, is structured to be disposed in a gap 122 between the pair of adjacent movable contact arms 104,104'. Thus, the protrusion, which is preferably an elongated tab 124, functions to secure the spring guide 112 with respect to the movable contact arms 104,104' and, therefore, to maintain alignment between the movable contact arms 104,104' and the corresponding single contact spring 108. The example elongated tab 124 extends from about the first end 130 of the planar portion 116 of the guide member 114 to the second end 132, intermediate the first and second opposing edges 126, 128 of the guide member 114.

The relationship of the spring guide 112 with respect to the contact spring 108 and corresponding movable contact arms 104,104' is further achieved and maintained by a projection 140, which projects outwardly from the second side 120 of the planar portion 116 of the guide member 114. As shown in the example of FIG. 5A, the projection 140 preferably has a generally cylindrical shape, and engages (e.g., is disposed within) the contact spring 108, as shown in hidden line drawing in FIG. 6. Specifically, each of the contact springs 108 (FIGS. 4A, 4B and 6) includes a first end 134, a second end 136 disposed opposite and distal from the first end 134, and a plurality of coils 138 extending therebetween. As shown in hidden line drawing in FIG. 6, the generally cylindrical projection 140 extends into the coil 138 of the corresponding contact spring 108 such that, when the carrier assembly 100 is assembled as shown, the first end 134 of the contact spring 108 engages the aforementioned portion 110 of the carrier body 102, and the second end 136 of the contact spring 108 abuts the second side 120 of the planar portion 116 of the guide member 114. It will, however, be appreciated that features (e.g., without limitation, planar portion 116; protrusion 124; projection 140) of the guide member 114 could have any known or suitable alternative configuration (not shown) for establishing and maintaining the desired orientation (e.g., alignment) between each contact spring 108 and the corresponding plurality (e.g., without limitation, adjacent pair) of movable contact arms 104,104' (FIG. 6), without departing from the scope of the disclosed concept.

Figure 2A:
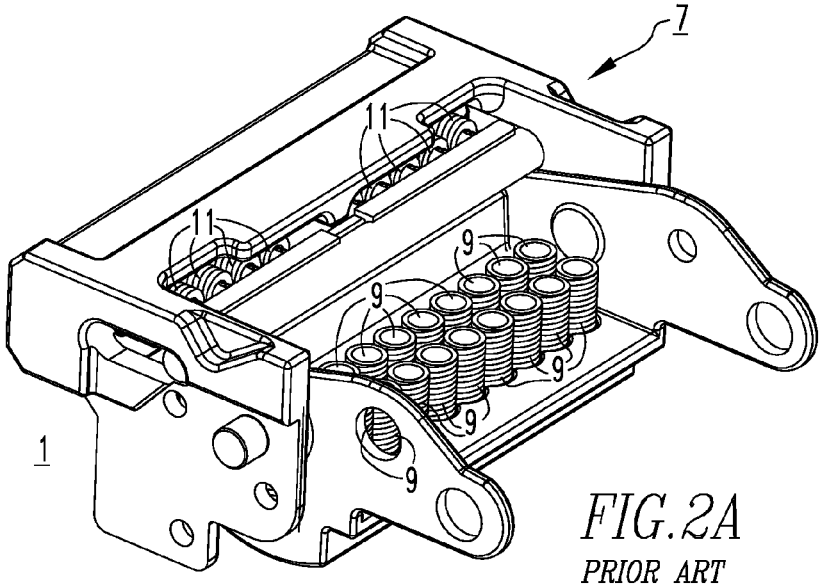
FIG.2A PRIOR ART
FIG. 2A is an isometric view of the carrier assembly of FIG. 1.
Figure 2B:
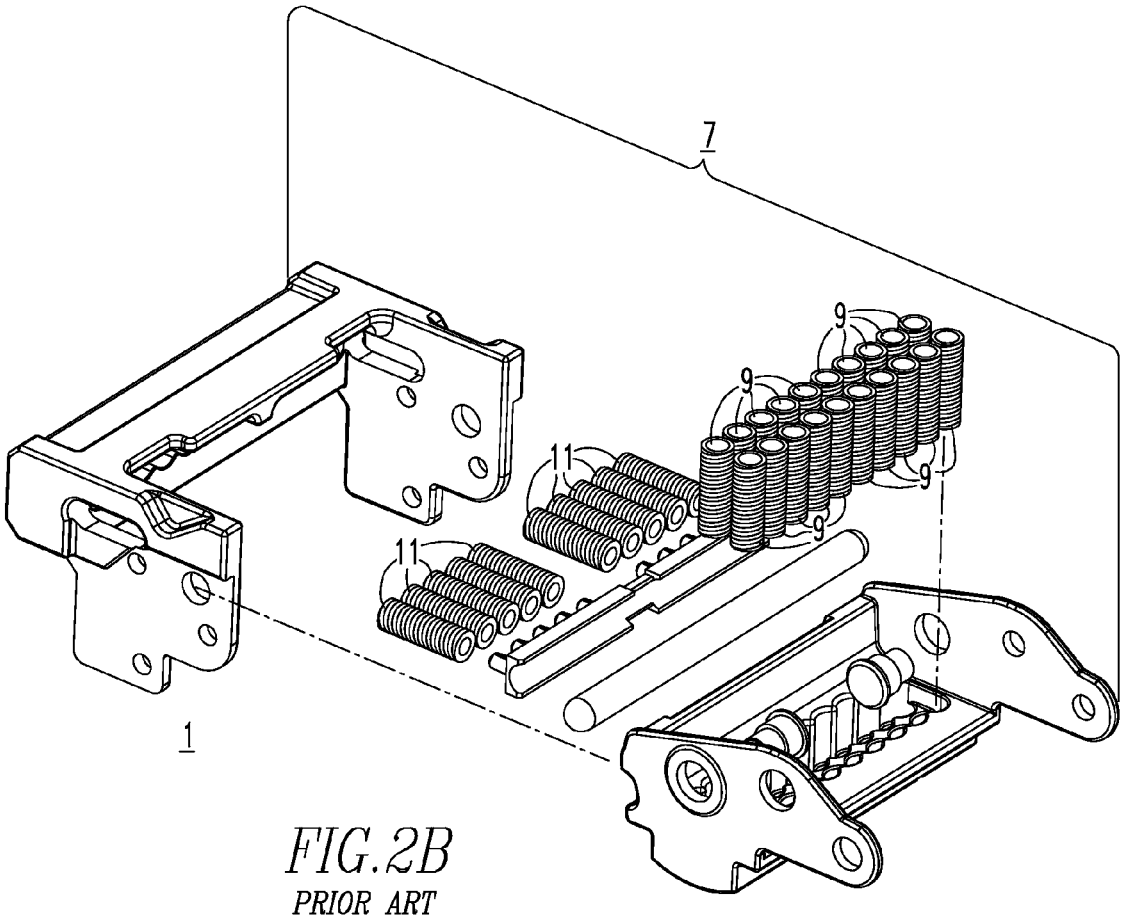
FIG.2B PRIOR ART
FIG. 2B is an exploded isometric view of the carrier assembly of FIG. 2A.

Accordingly, it will be appreciated that the disclosed spring guide 112 not only functions to facilitate the relatively quick, easy and correct assembly of the carrier assembly 100 (FIGS. 3, 4A, 4B and 6), but also enables a lesser number (e.g., without limitation five) of contact springs 108 to be employed in comparison with known carrier assemblies (see, for example, carrier assembly 7 of FIGS. 2A and 2B, which employs twenty contact springs 9). This reduced number of contact springs 108 further simplifies the assembly process and alleviates potential misalignment issues associated therewith. In addition, larger springs (compare, for example, contact springs 108 of FIGS. 4A, 4B and 6 to the relatively smaller contact springs 9 of FIGS. 2A and 2B) to be employed, which provides the further benefit of allowing for substantial freedom in the design of the springs to be used. This, in turn, permits enhanced spring forces to be achieved with less stress on the springs 108 and/or the components (e.g., without limitation, carrier body 102; movable contact arms 104,104') on which the springs 108 act. More strict acceptance criteria with respect to acceptable contact spring force can, be achieved, which, therefore, enables the circuit breaker (indicated generally by reference 50 in FIG. 3) to achieve relatively high withstand ratings (e.g., without limitation, up to about 50 kA or more for a three-pole circuit breaker; up to about 85 kA or more for a six-pole circuit breaker).

In addition to the aforementioned spring guides 112, the carrier assembly 100 is preferably adjustable and, therefore, overcomes disadvantages (e.g., without limitation, difficult assembly; improper alignment; blow off force out of specification) associated with known carrier assemblies (see, for example, carrier assembly 7 of FIGS. 1, 2A and 2B), which are not adjustable. Specifically, to ensure that the circuit breaker (indicated generally by reference 50 in FIG. 3) will function properly in service, the carrier assembly 100 (FIGS. 3, 4A, 4B and 6) is tested to verify that the required blow off force is within predetermined upper and lower limits. Accordingly, it is desirable to reduce or minimize the number of rejections in order to increase or maximize production yield of carrier assemblies 100 (FIGS. 3, 4A, 4B and 6), particularly in view of its relatively high cost.

The adjustable nature of the disclosed carrier assembly 100 enables it to be relatively quickly and easily assembled and adjusted to be within requisite or desired engineering specification limits (e.g., without limitation, a predetermined bias force for opposing the blow off force). For example and without limitation, the production yield of some conventional carrier assemblies (e.g., without limitation, carrier assembly 7 of FIGS. 1, 2A and 2B) is about 70 percent to about 80 percent, whereas the adjustable carrier assembly 100 substantially improves production yield to at or about 100 percent.

The carrier body 102 of the adjustable carrier assembly 100 preferably includes a first carrier member 150 and a second carrier member 152, which is pivotably coupled to the first carrier member 150 by pin members 153, as shown in FIG. 4A (see also FIG. 4B). An adjustment mechanism 154 is coupled to the carrier body 102, and a plurality of springs 156, sometimes referred to as blow off springs or cam springs, are disposed between the adjustment mechanism 154 and the second carrier member 152. The springs 156 apply a bias force (e.g., opposing the blow off force) on the second carrier member 152. As described hereinbelow, the adjustment mechanism 154 is adjustable with respect to the carrier body 102 to adjust the bias force.

In the example shown and described herein, the adjustment mechanism 154 includes an elongated member 158 and a number of fasteners, such as the first and second screws 160,162 shown in FIGS. 4A, 4B and 6. The first fastener 160 fastens the first end 166 of the elongated member 158 to the first carrier member 150, and the second fastener 162 fastens the second end 168 of the elongated member 158 to the first carrier member 150, as shown in FIG. 4A. As indicated generally by arrow 164 of FIG. 4A, the fasteners 160,162 can be tightened to move the elongated member 158 of the adjustment mechanism 154 toward (e.g., to the right from the perspective of FIG. 4A) the first carrier member 150, thereby increasing the aforementioned bias force, and they can be loosened to move the elongated member 158 away from (e.g., to the left from the perspective of FIG. 4A) the first carrier member 150, thereby decreasing the bias force.

As shown in FIG. 4B, the intermediate portion 170 of the elongated member 158, between the first and second ends 166,168 thereof, includes at least one recess 172. In the example of FIG. 4B, such intermediate portion 170 includes ten receptacles 172, each shaped to receive an end (e.g., second end 176) of a corresponding one of the ten blow off springs 156. For ease of illustration, the features of only one blow off spring 156 are labeled, although it will be appreciated that the remaining blow off springs 156 are substantially identical. Specifically, each blow off spring 156 includes a first end 174, the second end 176 disposed opposite and distal from the first end 174, and a plurality of coils 178 extending therebetween. The first end 174 of each spring 156 is disposed proximate the second carrier member 152 of the carrier body 102, and the second end 176 is disposed in the corresponding receptacle 172 of intermediate portion 170 of the adjustment mechanism elongated member 158. It will, however, be appreciated that any known or suitable alternative number and/or configuration of blow off springs 156 and/or recesses (e.g., 172) therefor, could be employed without departing from the scope of the disclosed concept.

Continuing to refer to FIG. 4B, the first carrier member 150 of the example carrier body 102 includes first and second opposing sidewalls 180,182. A body portion 184 extends between the sidewalls 180,182. The second carrier member 152 is pivotably coupled to the first and second sidewalls 180,182 by the aforementioned pin members 153 and is disposed therebetween, as shown in FIG. 4A. The first sidewall 180 includes a first slot 186 and the second sidewall 182 includes a second slot 188. The carrier body 102 further includes a rod 190 having a first end 192 movably disposed within the first slot 186 of the first sidewall 180, and a second end 194 movably disposed within the second slot 188 of the second sidewall 182. Thus, the blow off springs 156 function to bias the rod 190 against the second carrier member 152 of the carrier body 102 to provide the desired mechanical blow off force, which can advantageously be adjusted.

More specifically, the blow off springs 156 engage an elongated spring retainer 202 which, in turn, cooperates with the rod 190 to engage and bias the second carrier member 152 of the adjustable carrier assembly 100. Accordingly, when the adjustable carrier assembly 100 is assembled, the first end 174 of each of the blow off springs 156 cooperates with the second carrier member 152 on a first side 196 of the body portion 184 of the first carrier member 150, and the second end 176 of each blow off spring 156 cooperates with the adjustment mechanism 154 on a second side 198 of the first carrier member body portion 184. Thus, each of the springs 156 extends through a corresponding aperture 200 (partially shown in hidden line drawing in FIG. 4B; see also FIGS. 3 and 4A) of the body portion 184 of the first carrier member 150. It will, however, be appreciated that the first carrier member 150 of the carrier body 102 could have any known or suitable alternative number and/or configuration of apertures (e.g., 200) for suitably receiving the coils 178 of blow off springs 156 therethrough.

The aforementioned elongated spring retainer 202 of the carrier body 102, which is best shown in the exploded view of FIG. 4B, includes a first side 204 having a plurality of projections 206 extending outwardly therefrom, and a second side 208 having an arcuate shape. The arcuate shape of the second side 208 of the elongated spring retainer 202 engages the rod 190, as shown in FIG. 4A, and as previously described hereinabove. Each of the projections 206 of the first side 204 of the elongated spring retainer 202 is structured to be disposed within a number of the coils 178 of a corresponding one of the blow off springs 156, in order to retain the first end 174 thereof.

Accordingly, the disclosed carrier assembly 100 (FIGS. 3, 4A, 4B and 6) is advantageously adjustable, thereby enabling it to be relatively quickly and easily assembled and adjusted to be within requisite or desired engineering specification limits (e.g., without limitation, for a bias force opposing a blow off force). This, in turn, greatly reduces the number of carrier assemblies that would otherwise be rejected and discarded if they did not meet specification and had no ability to be adjusted to do so. Thus, among other benefits, production yield of the carrier assembly 100 is increased. Additionally, the adjustable nature of the carrier assembly 100 enables it to be fine-tuned to within a specific desired operating range, and substantially eliminates excessively high initial spring forces that can occur during assembly and disadvantageously induce stress fractures in critical operating components (e.g., without limitation, carrier body 102).

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An adjustable carrier assembly for an electrical switching apparatus, said adjustable carrier assembly comprising:

a carrier body comprising a first carrier member and a second carrier member pivotably coupled to the first carrier member;

an adjustment mechanism coupled to said carrier body;

a plurality of springs disposed between said adjustment mechanism and the second carrier member, said springs being structured to apply a bias force on the second carrier member;

wherein said adjustment mechanism is adjustable with respect to said carrier body in order to adjust said bias force; and wherein said adjustment mechanism comprises an elongated member and a number of fasteners; wherein said fasteners fasten said elongated member to the first carrier member of said carrier body; wherein said fasteners are structured to be tightened to move said elongated member toward the first carrier member, thereby increasing said bias force; and wherein said fasteners are structured tobe loosened to move said elongated member away, from the first carrier member, thereby decreasing said bias force.

2. The adjustable carrier assembly of claim 1 wherein said number of fasteners is a first fastener and a second fastener; wherein said elongated member includes a first end, a second end disposed opposite and distal from the first end, and an intermediate portion extending therebetween; wherein the first fastener fastens the first end of said elongated member to the first carrier member; and wherein the second fastener fastens the second end of said elongated member to the first carrier member.

3. The adjustable carrier assembly of claim 1 wherein the intermediate portion of said elongated member includes at least one recess;

wherein said springs each include a first end, a second end and a plurality of coils extending therebetween; wherein the first end of each of said springs is disposed proximate to the second carrier member of said carrier body; and wherein the second end of each of said springs is disposed in a corresponding one of said at least one recess of the intermediate portion of said elongated member.

4. The adjustable carrier assembly of claim 3 wherein said at least one recess is a plurality of receptacles; and wherein each of said receptacles receives the second end of a corresponding one of said springs.

5. The adjustable carrier assembly of claim 4 wherein said plurality of springs is ten elongated springs; wherein said plurality of receptacles is ten receptacles; and wherein each of said ten receptacles receives the second end of a corresponding one of said ten elongated springs.

6. An adjustable carrier assembly for an electrical switching apparatus, said adjustable carrier assembly comprising:

a carrier body comprising a first carrier member and a second carrier member pivotably coupled to the first carrier member;

an adjustment mechanism coupled to said carrier body;

a plurality of springs disposed between said adjustment mechanism and the second carrier member, said springs being structured to apply a bias force on the second carrier member;

wherein said adjustment mechanism is adjustable with respect to said carrier body in order to adjust said bias force;

wherein the first carrier member of said carrier body comprises a first sidewall, a second sidewall disposed opposite and spaced apart from said first sidewall, and a body portion extending between said first sidewall and said second sidewall; wherein the second carrier member is pivotably coupled to said first sidewall and said second sidewall; wherein said first sidewall includes a first slot; wherein said second sidewall includes a second slot; wherein said carrier body further comprises a rod extending between said first sidewall and said second sidewall; wherein said rod includes a first end movably disposed within the first slot of said first sidewall and a second end movably disposed within the second slot of said second sidewall; and wherein said springs are structured to bias said rod against the second carrier member of said carrier body; and wherein said springs each include a first end, a second end and a plurality of coils extending therebetween; wherein said body portion of the first carrier member includes a first side facing the second carrier member, a second side facing said adjustment mechanism, and a number of apertures; and wherein said springs extend through said apertures in order that the first end of each of said springs cooperates with the second carrier member on the first side of said body portion, and the second end of each of said springs cooperates with said adjustment mechanism on the second side of said body portion.

7. The adjustable carrier assembly of claim 6 wherein said carrier body further comprises an elongated spring retainer; wherein said elongated spring retainer includes a first side having a plurality of projections and a second side having an arcuate shape; wherein the arcuate shape of the second side of said elongated spring retainer engages said rod; and wherein each of said projections of the first side of said elongated spring retainer is disposed within the coils of a corresponding one of said springs in order to retain the first end of said corresponding one of said springs.

8. An electrical switching apparatus comprising:

a number of stationary contacts; and at least one carrier assembly comprising:

a carrier body comprising a first carrier member and a second carrier member pivotably coupled to the first carrier member, a plurality of movable contact arms coupled to the second carrier member, each of said movable contact arms including a movable contact being movable into and out of electrical contact with a corresponding one of said number of stationary contacts;

an adjustment mechanism coupled to said carrier body;

a plurality of springs disposed between said adjustment mechanism and the second carrier member, said springs applying a bias force on the second carrier member;

wherein said adjustment mechanism is adjustable with respect to said carrier body in order to adjust said bias force; and wherein said adjustment mechanism of said at least one carrier assembly comprises an elongated member and a number of fasteners; wherein said fasteners fasten said elongated member to the first carrier member of said carrier body of said at least one carrier assembly; wherein, when said fasteners are tightened, said elongated member moves toward the first carrier member, thereby increasing said bias force; and wherein, when said fasteners are loosened, said elongated member moves away from the first carrier member, thereby decreasing said bias force.

9. The electrical switching apparatus of claim 8 wherein said number of fasteners is a first fastener and a second fastener; wherein said elongated member includes a first end, a second end disposed opposite and distal from the first end, and an intermediate portion extending therebetween; wherein the first fastener fastens the first end of said elongated member to the first carrier member; and wherein the second fastener fastens the second end of said elongated member to the first carrier member.

10. The electrical switching apparatus of claim 8 wherein the intermediate portion of said elongated member includes at least one recess; wherein said springs each include a first end, a second end and a plurality of coils extending therebetween; wherein the first end of each of said springs is disposed proximate to the second carrier member of said carrier body; and wherein the second end of each of said springs is disposed in a corresponding one of said at least one recess of the intermediate portion of said elongated member.

11. The electrical switching apparatus of claim 10 wherein said at least one recess is a plurality of receptacles; and wherein each of said receptacles receives the second end of a corresponding one of said springs.

12. The electrical switching apparatus of claim 11 wherein said plurality of springs of said at least one carrier assembly is ten elongated springs; wherein said plurality of receptacles is ten receptacles; and wherein each of said ten receptacles receives the second end of a corresponding one of said ten elongated springs.

13. An electrical switching apparatus comprising:

a number of stationary contacts; and at least one carrier assembly comprising:

a carrier body comprising a first carrier member and a second carrier member pivotably coupled to the first carrier member;

a plurality of movable contact arms coupled to the second carrier member, each of said movable contact arms including a movable contact being movable into and out of electrical contact with a corresponding one of said number of stationary contacts;

an adjustment mechanism coupled to said carrier body;

a plurality of springs disposed between said adjustment mechanism and the second carrier member, said springs applying a bias force on the second carrier member;

wherein said adjustment mechanism is adjustable with respect to said carrier body in order to adjust said bias force;

wherein the first carrier member of said carrier body of said at least one carrier assembly comprises a first sidewall, a second sidewall disposed opposite and spaced apart from said first sidewall, and a body portion extending between said first sidewall and said second sidewall; wherein the second carrier member is pivotably coupled to said first sidewall and said second sidewall; wherein said first sidewall includes a first slot; wherein said second sidewall includes a second slot; wherein said carrier body of said at least one carrier assembly further comprises a rod extending between said first sidewall and said second sidewall; wherein said rod includes a first end movably disposed within the first slot of said first sidewall and a second end movably disposed within the second slot of said second sidewall; and wherein said springs bias said rod against the second carrier member of said carrier body; and wherein said springs of said at least one carrier assembly each include a first end, a second end and a plurality of coils extending therebetween; wherein said body portion of the first carrier member includes a first side facing the second carrier member, a second side facing said adjustment mechanism, and a number of apertures; and wherein said springs extend through said apertures in order that the first end of each of said springs cooperates with the second carrier member on the first side of said body portion, and the second end of each of said springs cooperates with said adjustment mechanism on the second side of said body portion.

14. The electrical switching apparatus of claim 13 wherein said carrier body of said at least one carrier assembly further comprises an elongated spring retainer, wherein said elongated spring retainer includes a first side having a plurality of projections and a second side having an arcuate shape; wherein the arcuate shape of the second side of said elongated spring retainer engages said rod; and wherein each of said projections of the first side of said elongated spring retainer is disposed within the coils of a corresponding one of said springs in order to retain the first end of said corresponding one of said springs.

* * * * *